US005227698A

United States Patent [19]

Simpson et al.

[11] Patent Number: 5,227,698

[45] Date of Patent: Jul. 13, 1993

[54] MICROWAVE LAMP WITH ROTATING FIELD

[75] Inventors: James E. Simpson, Gaithersburg; Mohammad Kamarehi, Rockville, both of Md.

[73] Assignee: Fusion Systems Corporation, Rockville, Md.

[21] Appl. No.: 850,278

[22] Filed: Mar. 12, 1992

[51] Int. Cl.[5] ..... H05B 41/16

[52] U.S. Cl. ..... 315/248; 315/39

[58] Field of Search ..... 315/248, 39, 344; 313/607, 234

[56] References Cited

U.S. PATENT DOCUMENTS

| | | | |
|---|---|---|---|
| 3,157,823 | 11/1964 | Clapp | 315/169 |
| 3,872,349 | 3/1975 | Spero | 315/39 |
| 4,042,850 | 8/1977 | Ury | 315/39 |
| 4,284,868 | 8/1981 | Simpson | 219/10.55 F |
| 4,327,266 | 4/1982 | Austin et al. | 219/10.55 F |
| 4,335,289 | 6/1982 | Smith | 219/10.55 F |
| 4,414,453 | 11/1983 | Simpson | 219/10.55 F |
| 4,431,888 | 2/1984 | Simpson | 219/10.55 F |
| 4,504,768 | 3/1985 | Ury | 315/39 |
| 4,580,023 | 4/1986 | Simpson | 219/10.55 F |
| 4,596,915 | 6/1986 | Simpson | 219/10.55 F |
| 4,641,006 | 2/1987 | Ross et al. | 219/10.55 F |
| 4,749,915 | 6/1988 | Lynch | 315/248 |
| 4,792,732 | 12/1988 | O'Loughlin | 315/334 |
| 4,933,602 | 6/1990 | Ono | 315/39 |
| 4,954,755 | 9/1990 | Lynch | 315/248 |
| 4,975,625 | 12/1990 | Lynch | 315/248 |
| 5,008,593 | 4/1991 | Schlie | 315/39 |

FOREIGN PATENT DOCUMENTS 56-141165 11/1981 Japan .

*Primary Examiner*—Eugene R. LaRoche
*Assistant Examiner*—A. Zarabian
*Attorney, Agent, or Firm*—Pollock, Vande Sande & Priddy

[57] ABSTRACT

A microwave powered lamp wherein microwave energy is coupled to a cavity in which an electrodeless bulb is disposed, such that a rotating field of constant ellipticity is established in the cavity.

41 Claims, 17 Drawing Sheets

MICROWAVE LAMP WITH ROTATING FIELD

The present invention is directed to an improved microwave powered electrodeless lamp which is capable of providing a uniform light output.

Electrodeless lamps are well known in the prior art, and may be comprised of a microwave cavity in which a bulb having an excitable fill is disposed. The cavity is typically comprised of a solid metallic portion which may serve as a reflector for the emitted light, and a mesh portion which contains microwaves in the cavity, but which allows the light to exit. A microwave source such as a magnetron generates microwave energy, which is fed to the cavity and coupled thereto to excite the fill in the bulb.

In such lamps, a number of interrelated factors determine the pattern of the electric and magnetic fields in the cavity and specifically at the particular location of the bulb. These factors include the size and shape of the cavity, the frequency and power of the microwave field, the size and degree of loss of the bulb, and the specific coupling arrangement.

A problem with prior art electrodeless lamps is that the light which they emit is not completely uniform. This is because the electric field in the cavity which excites the fill is not uniform throughout the volume of the bulb and is not even symmetrical about the axis of the lamp. The non-uniform light output of the bulb is typically continued throughout the optical system of the device, and results in non-uniform irradiation of the target area.

A related problem is that some particular bulb fills do not run efficiently when excited by a field which is not uniform. An example of this is fills which contain the element dysprosium, which fills require a very uniform field for proper operation.

In the typical point source electrodeless lamp, there is a single coupling slot in the cavity which is fed by a single magnetron. U.S. Pat. No. 4,749,915 to Lynch, et al., in order to increase the power which is fed to the cavity, discloses the use of two magnetrons, each of which is fed to a coupling slot. In this arrangement the slots are orthogonally situated with relation to each other around a cylindrical cavity, and one effect is that the field uniformity is increased. The reason for this is that since no two magnetrons have exactly the same frequency, the phase difference between the two magnetrons will be constantly varying, with the fields produced by the two coming into and out of phase according to the beat frequency. Since the two fields add in the cavity, the result of this is a rotating field, the magnitude of which varies as it rotates through 360°. Furthermore, the variation with rotation changes with the changing phase difference between the two fields, with the varying polarization being circular only at those instants of time when the phase difference between the two fields passes through 90°.

In accordance with the present invention, to provide a more uniform field at the bulb, a rotating electric field is provided in the cavity, but unlike in the case of the prior art discussed above, the polarization is arranged to have a constant ellipticity from cycle to cycle, thus permitting the degree of uniformity of the field to be predictably controlled. In the preferred embodiment of the invention, the constant ellipticity of the rotating field is unity, i.e., the field is circularly polarized. In addition to the improved uniformity which may be afforded by the invention, it is advantageous as compared with the prior art arrangement in U.S. Pat. No. 4,749,915 because it requires the use of only a single magnetron.

When a microwave electrodeless bulb such as the one disclosed herein is operating, the bulb dissipates the electromagnetic energy that is resonating in the cavity. The real component of the impedance dissipates energy, while both the real and imaginary components of the impedance cause an alteration of the field pattern from that of an unloaded cavity. The present invention applies to what are termed resonant and nonresonant lamps, wherein as is known, those terms apply to the Q or "quality", and the ratio of stored energy to energy lost per oscillation.

It is therefore an object of the invention to provide an electrodeless lamp which is capable of being operated to provide more uniform radiation.

It is a further object of the invention to provide an electrodeless lamp which is capable of utilizing bulb fills which require a more uniform field for proper operation.

It is still a further object of the invention to provide advantageous microwave transmission means for effecting coupling of microwave energy to the cavities of electrodeless lamps.

The invention will be better understood by referring to the accompanying drawings wherein.

Figure 7:
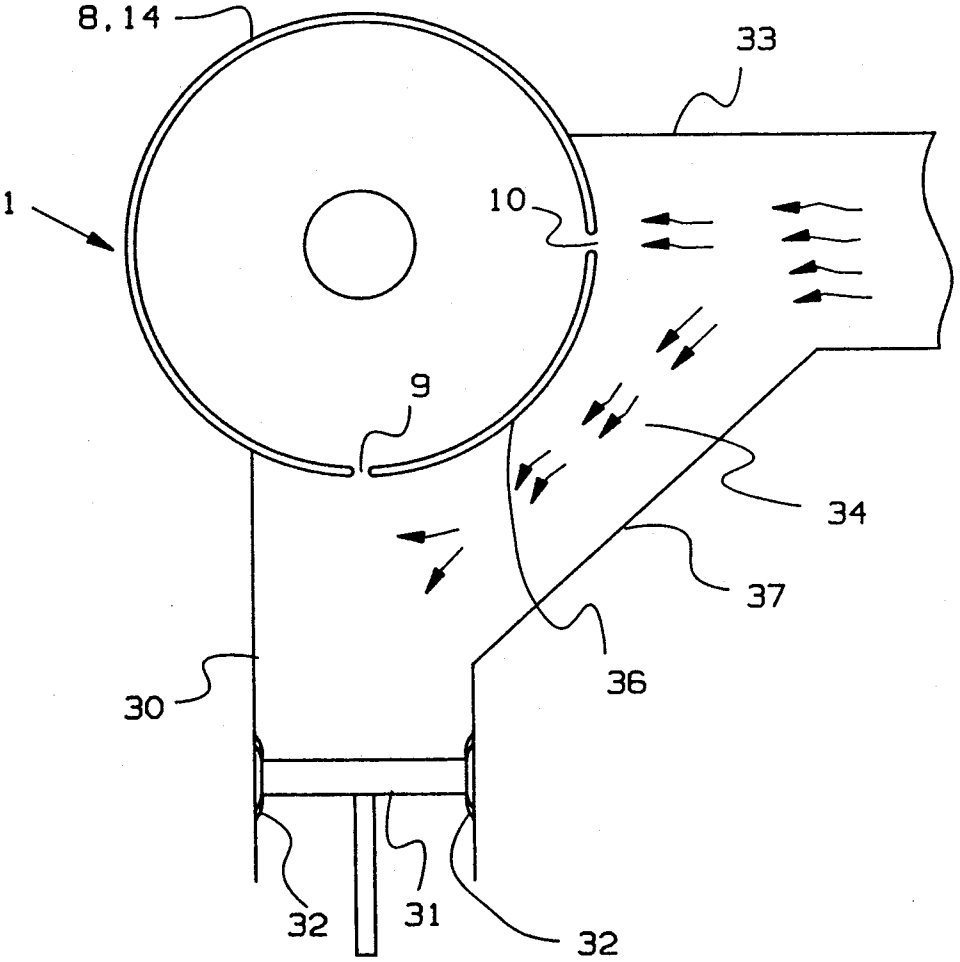
FIG. 7 shows an embodiment of the invention which utilizes a shorted waveguide.
Figure 7A:
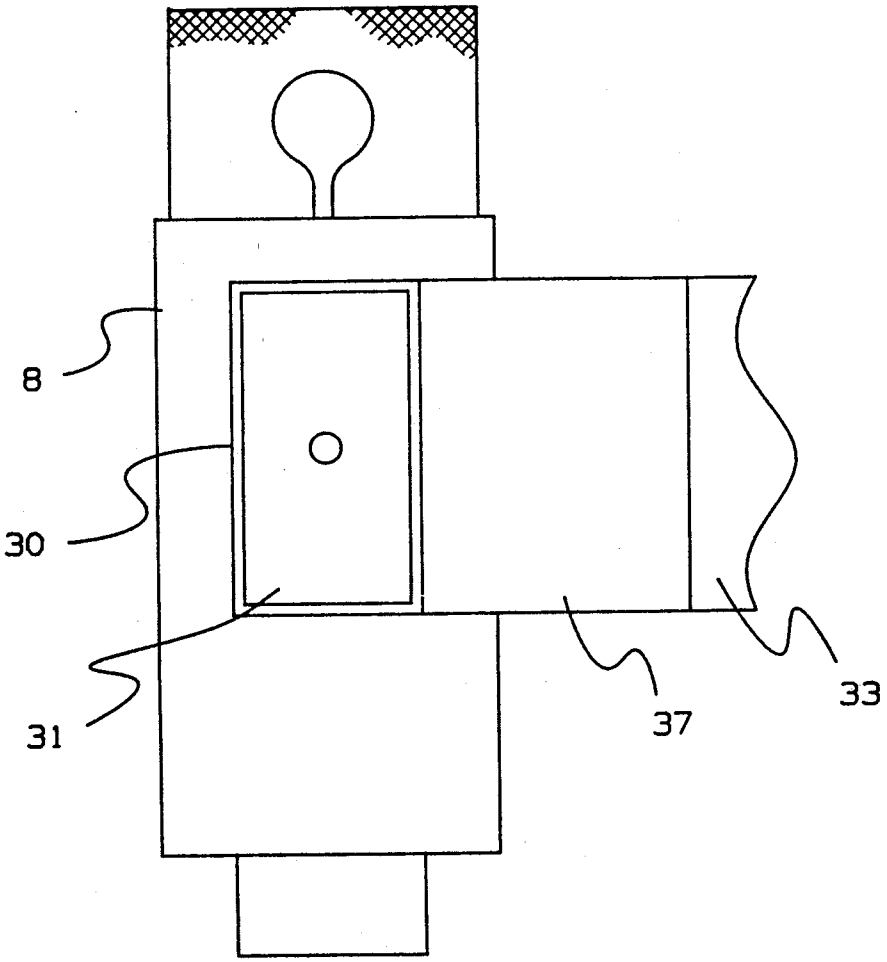

FIG. 7*a* is a side view of the embodiment shown in FIG. 7.

Figure 8:
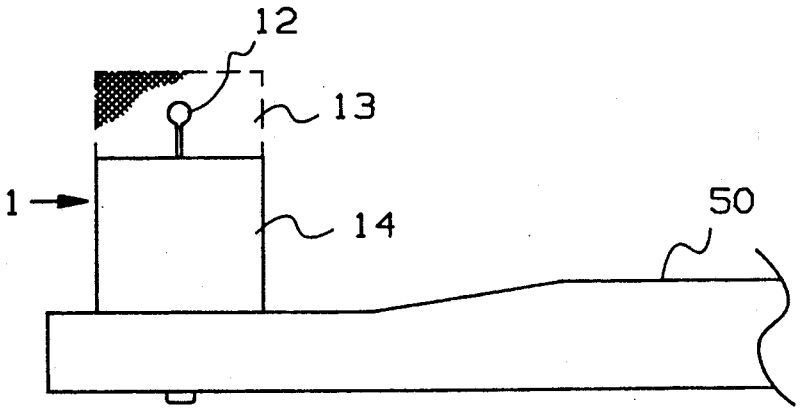

FIG. 8 is a side view of an embodiment of the invention wherein a $TE_{111}$ cavity is connected at its bottom end to a waveguide through a cross shaped coupling slot.

Figure 9:
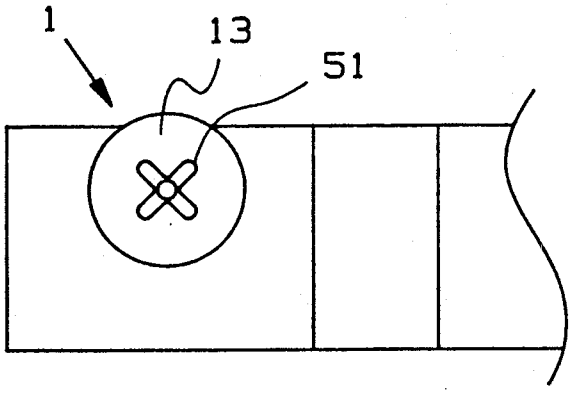

FIG. 9 is a top view of the embodiment depicted in FIG. 8.

Figure 10:
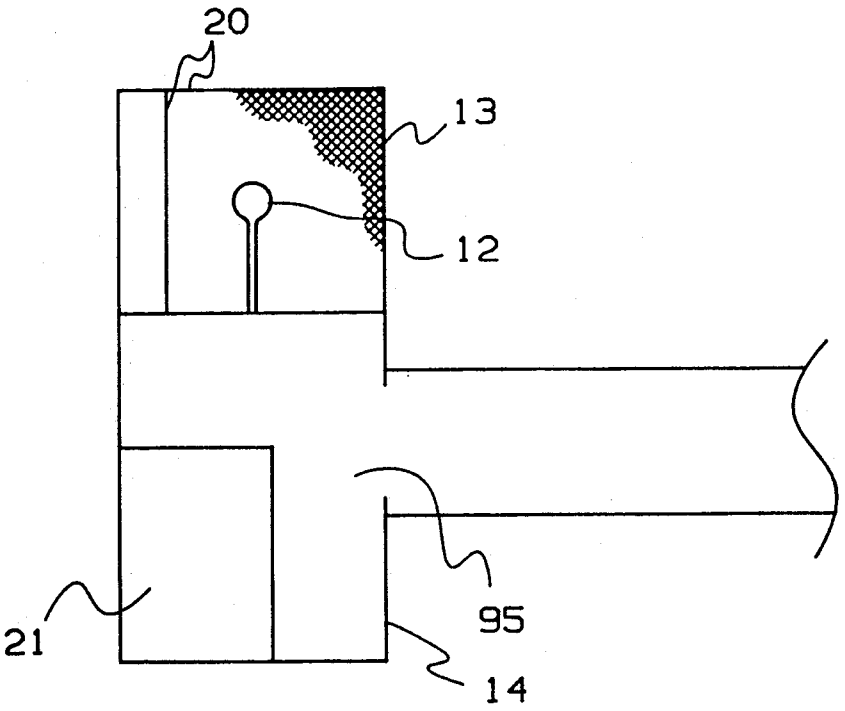

FIG. 10 is a side view of an embodiment of the invention which utilizes a modified cylindrical cavity.

Figure 11:
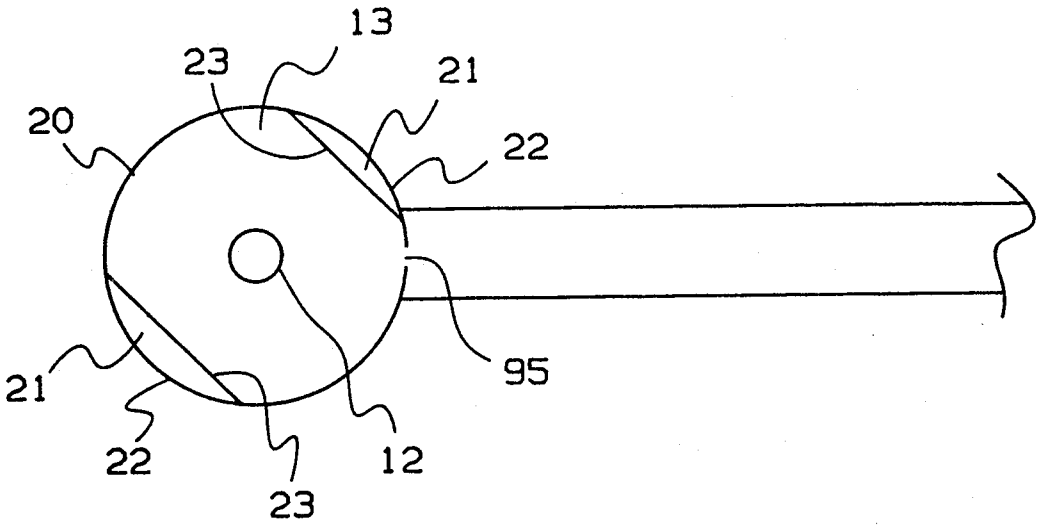

FIG. 11 is a top view of the embodiment shown in FIG. 10.

Figure 12:
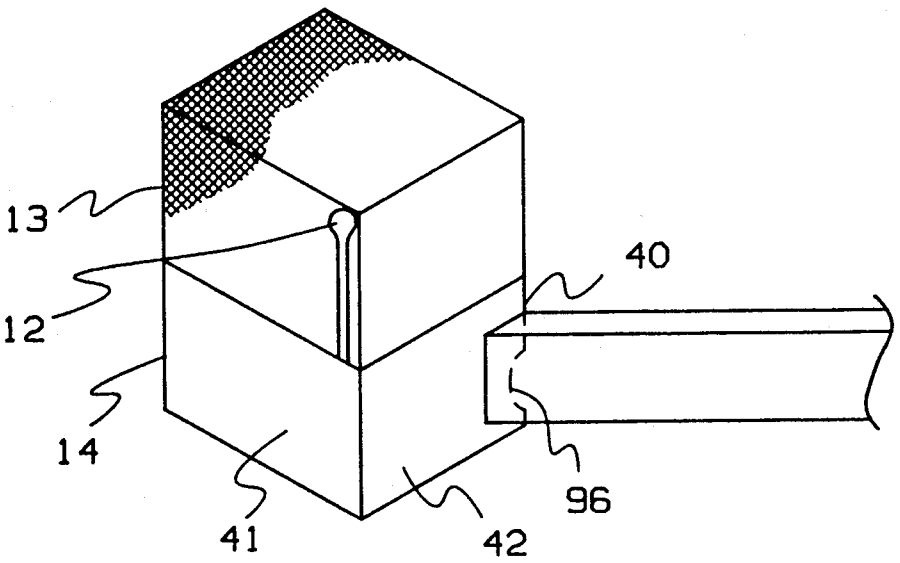

FIG. 12 is an embodiment of the invention which utilizes a cavity in the shape of a hexahedron.

Figure 13:
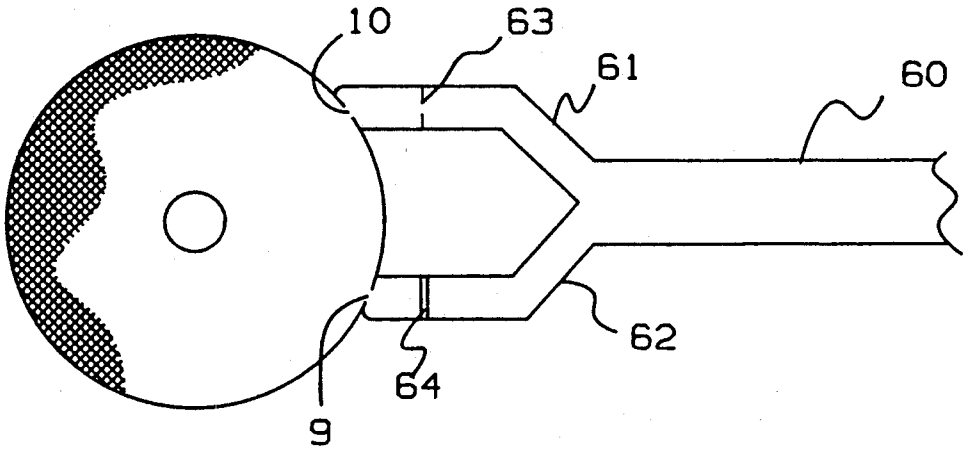

FIG. 13 shows an embodiment of the invention which utilizes a capacitive iris and an inductive iris to effect the phase shift.

Figure 14:
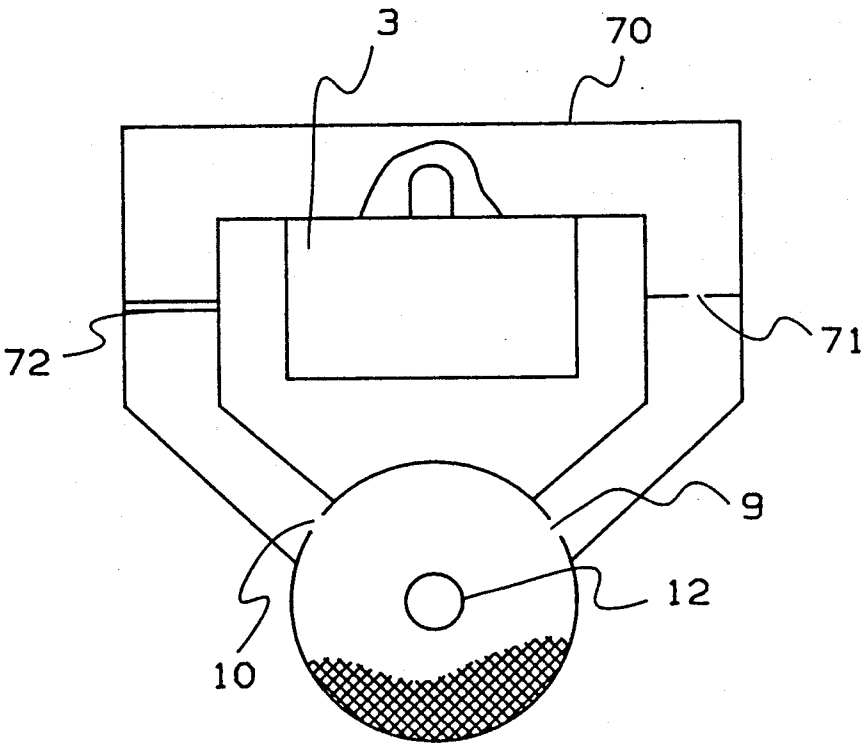

FIG. 14 shows a further embodiment of the invention.

Figure 15:
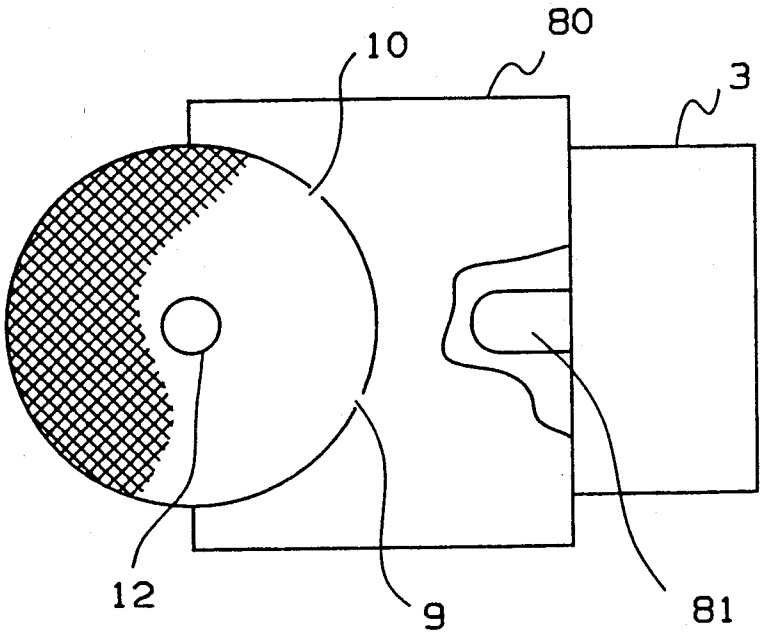

FIG. 15 shows an embodiment of the invention which utilizes a box-like coupling structure between the cavity and the microwave generator.

Figure 16:
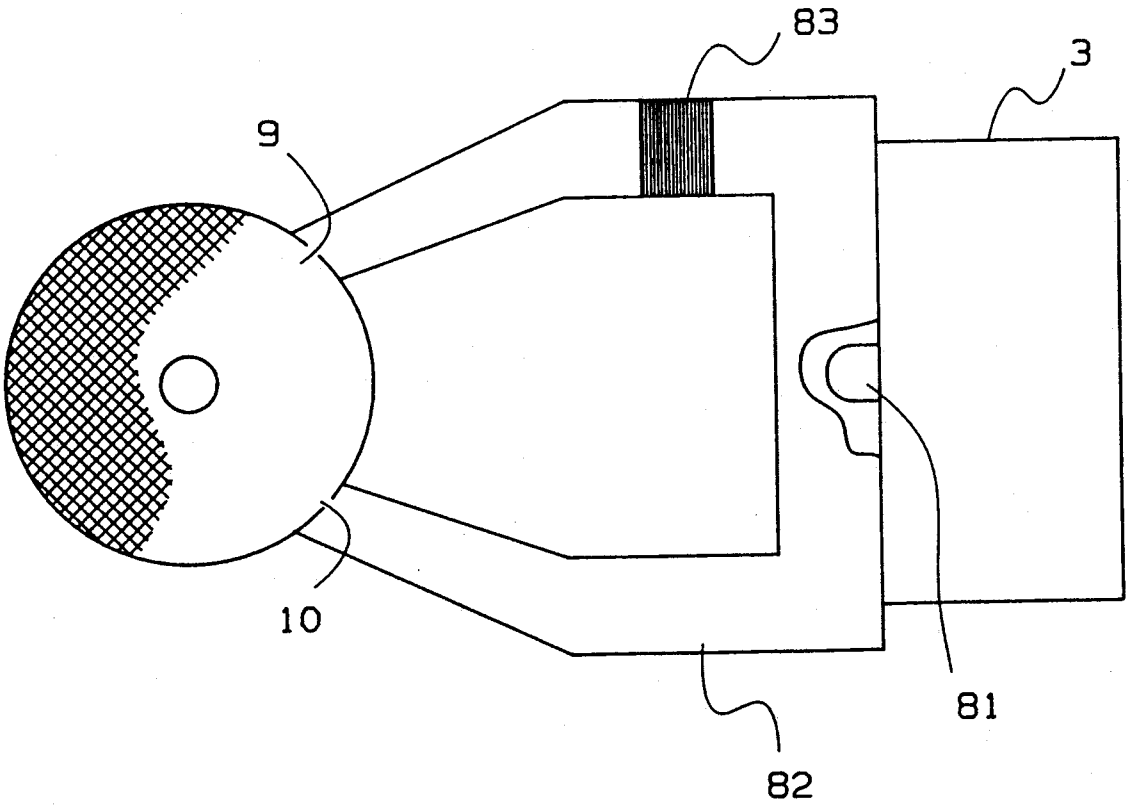

FIG. 16 shows an embodiment of the invention which utilizes a dielectric slab in the waveguide between the, magnetron and one end of the waveguide.

Figure 1:
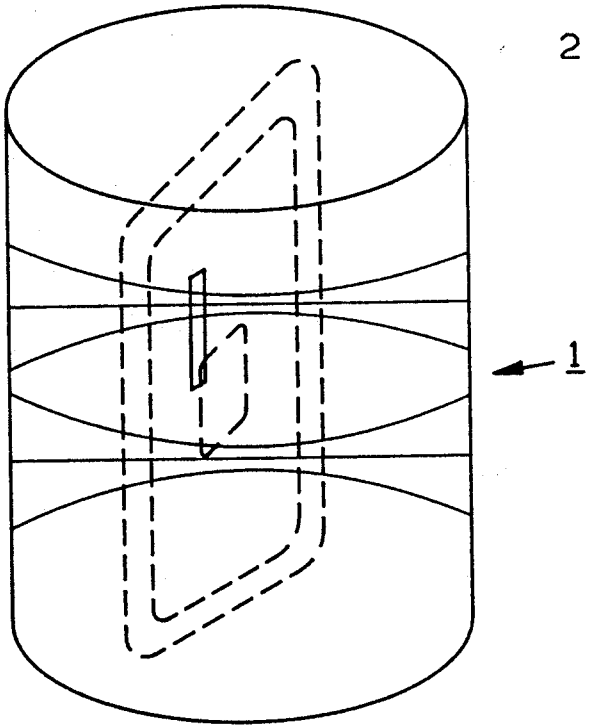
FIG. 1 shows the electric and magnetic field lines in a cylindrical $TE_{111}$ cavity at an instant in time.

FIG. 1 shows a cylindrical cavity 1 being operated in the $TE_{111}$ mode. The cavity has a coupling slot 17 in the cylindrical wall, and electric field lines, which are in the horizontal direction in the slot, appear in the same direction inside the cavity. These electric field lines 18 are the solid lines in the cavity in the Figure, and cross from one side of the cavity to the other, while the magnetic field lines 19 are represented by dashed lines in the Figure.

A cavity such as shown in FIG. 1 has been used in prior art electrodeless lamps. The problem with this arrangement is that the electric field is not uniform throughout the cavity, and in fact is not uniform about the vertical axis of a bulb which is disposed in the cavity. As discussed above, this results in the production of non-uniform radiation from the bulb. Furthermore, other types of prior art lamp cavities, besides the type shown in FIG. 1, result in non-uniform electric fields.

In accordance with the invention, the emission of uniform radiation is achieved by coupling microwave energy to the cavity so as to result in a rotating field of constant elliptical polarization from cycle to cycle within the cavity. Furthermore, the constant polarization may be controlled so as to achieve the desired degree of uniformity. Thus, when the polarization is circular, the field strength remains the same as the field rotates, and the field is rotationally symmetrical about the axis. While this is the preferred embodiment of the invention, it is possible to achieve an increase in uniformity as compared with the cavity shown in FIG. 1, when the field has a fixed elliptical, but not circular polarization. In this case, the closer the polarization is to circular, the more uniform the electric field in the cavity is as it rotates through 360°. For applications where a predetermined directional non-uniformity in the bulb output is deemed to be desirable, the invention may be used to provide such selective non-uniformity by controlling the polarization vectors of the elliptically polarized field. As used herein, the term "constant ellipticity", refers to an elliptically or circularly polarized field wherein the polarization vectors are constant from cycle to cycle.

In accordance with an aspect of the invention, the rotating electric field of constant polarization is obtained by establishing two fields in the cavity which are spatially displaced from each other and which have a constant phase difference between them. In the preferred embodiment, the fields are spatially displaced by 90°, are out of phase by 90°, and are of equal amplitude, thus resulting in a composite field which has a circular polarization. However, many combinations of spatial displacement and phase difference will result in a significant improvement in field uniformity. For example, fields of equal amplitude which are spatially displaced by 60° and out of phase by 75° will result in an improvement, as will fields which are spatially displaced by 120° and out of phase by 105°. Preferably, the spatial displacement of slots is between 85° and 95°, and the phase difference of the microwave signals is between 85° and 95°.

However, any combination of field amplitudes, spatial displacement, and phase displacement which results in a rotating field having an ellipticity of at least 0.6 will result in an improvement in uniformity, wherein the "ellipticity" is the ratio of the dimensions of the minor to major axis of the ellipse. Furthermore, as mentioned above, a predetermined directional non-uniformity may be provided in accordance with the invention by suitably controlling the spatial displacement and phase difference.

In the following examples, the fields are equal amplitudes, and are both spatially displaced and out of phase by 90°. However, it should be appreciated as described above, that other combinations of spatial displacements, phase differences and even amplitudes, may be used.

Figure 2:
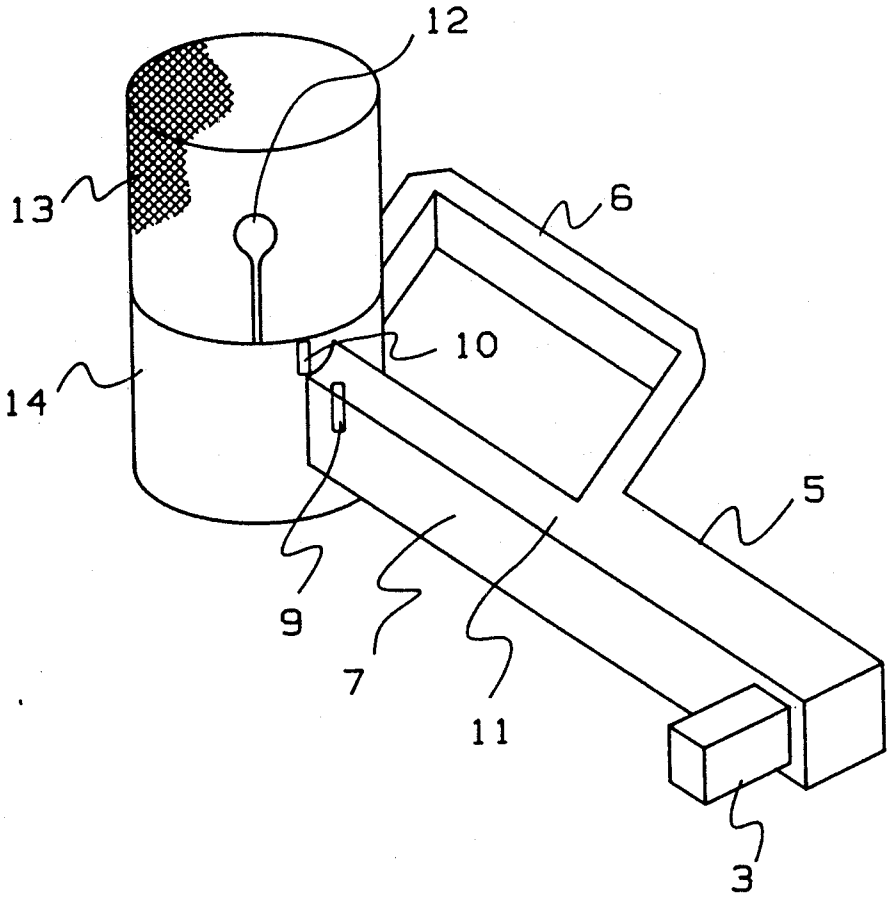
FIG. 2 shows an embodiment of the invention which utilizes waveguide branches of different length to effect phase shift.

Referring to FIG. 2, a first embodiment of the present invention is depicted. The lamp is seen to include a cylindrical cavity which is comprised of solid metallic portion 14 and mesh portion 13. A bulb 12 having an excitable fill is disposed in the cavity, such that the light which it emits may exit the cavity through mesh 13. The lamp is a high pressure discharge source where the fill is typically present in a range of 1 to 20 atmospheres during operation.

Coupling slots 9 and 10 are disposed in solid cylindrical portion 14, which may comprise a reflector, such that they displaced about 90° away from each other. Additionally, microwave energy of about equal amplitude is fed to the slots from microwave source 3 such that at the respective slots the microwave energy is about 90° out of phase. The resultant field rotates with constant amplitude, and at the interior surface of the lamp envelope, the field is rotationally symmetrical about the vertical axis of the envelope.

The above is accomplished by utilizing waveguide means which is arranged such that there is a different effective length between the source and each of the slots. Referring to the Figure, the waveguide is comprised of main portion 5, and branches 6 and 7, each of which is dimensioned to operate in the $TE_{10}$ mode. Additionally, branch 6 is arranged to be an odd number of quarter of wavelengths longer than branch 7, so that the signal which is fed to slot 10 is delayed by 90° with respect to the signal which is fed to slot 9.

As known to those skilled in the microwave art, each of the branches 6,7 may be half the height of the main waveguide 5, so that the impedances are matched, while the bends in branch 6 would normally be E plane bends.

The cylindrical cavity in this and the succeeding embodiments is preferably dimensioned to operate in the $TE_{111}$ mode, although other $TE_{11n}$ modes may be used. Thus, the microwave energy which is coupled through each slot is in the same mode. The cavity is typically a resonant cavity during operation, and each coupling slot will couple an electric field to the cavity which is parallel to the width of the slot. The two fields which are established in the cavity are of equal amplitude, are orthogonal to each other, and are 90° out of phase. Since the fields add in the cavity, the sum field will have a constant magnitude at the center axis and will rotate at a constant angular velocity once every high frequency cycle.

In the succeeding embodiments, the waveguide is shown with a break line, and it should be understood that the magnetron is mounted in a conventional way to the section of the waveguide which is not shown, usually at its end. In the succeeding figures, like numerals depict like parts.

Figure 3:
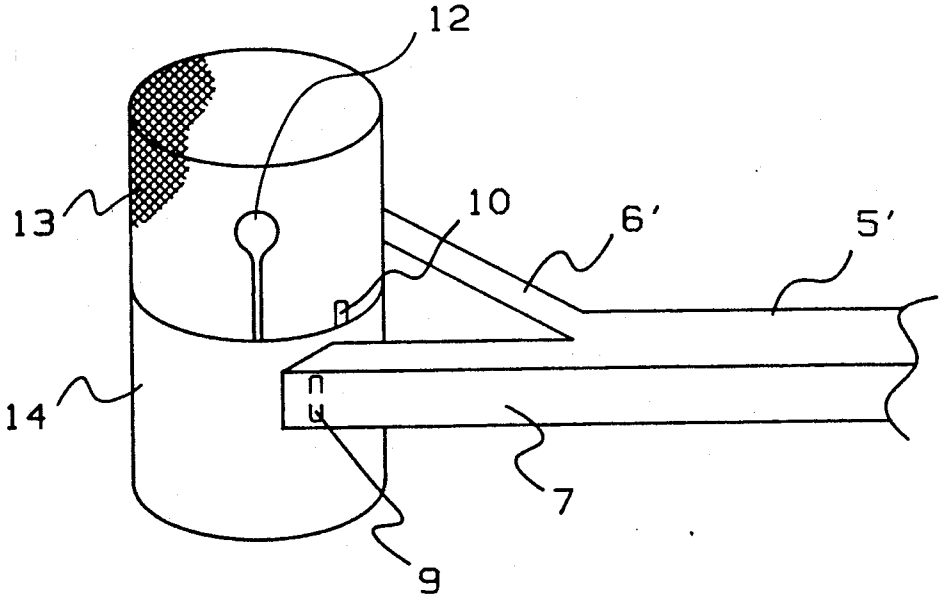
FIG. 3 shows an embodiment of the invention which uses a Y branched waveguide.

FIG. 3 depicts an embodiment in which a Y type waveguide branch is utilized. The main part of the waveguide 5' feeds branches 6' and 7'. Branch 6' is an odd multiple of one quarter the length of the wavelength of the microwave signal in the waveguide longer than branch 7'. The two coupling slots or irises 9, 10 are separated by 90° on the wall of the cylindrical cavity.

Figure 4:
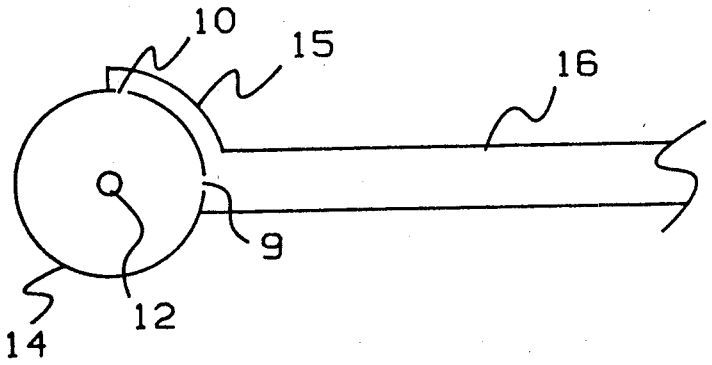
FIG. 4 shows an embodiment of the invention wherein a waveguide runs along a circumferential wall of the cavity.

FIG. 4 shows a cross section through a $TE_{111}$ cavity, and a waveguide which feeds the cavity. A waveguide portion 15 connects coupling slots 9 and 10 by wrapping around the cylindrical wall 14, while the main waveguide portion communicates with coupling slot 9. The coupling slots 9 and 10 are displaced by 90° around the cylindrical cavity wall and the distance along the waveguide portion 15 to the second coupling slot 10 is equal to an odd multiple of one quarter the wavelength of the microwave field as it propagates down the waveguide. In order to make the distance equal to an odd multiple of one quarter wavelength, the width of the waveguide can be changed or the diameter of the cavity can be changed. Increasing or decreasing the width of the waveguide branch 15 will decrease or increase respectively the length of the wavelength in the waveguide branch 15. At a given frequency, the diameter of a cylindrical cavity can be increased while still maintaining the desired $TE_{111}$ mode if the length is shortened appropriately. The correct diameter of the cavity and width of the waveguide branch 15 can be found by experiment supplemented by preliminary calculation, based on well known computational techniques.

Figure 5:
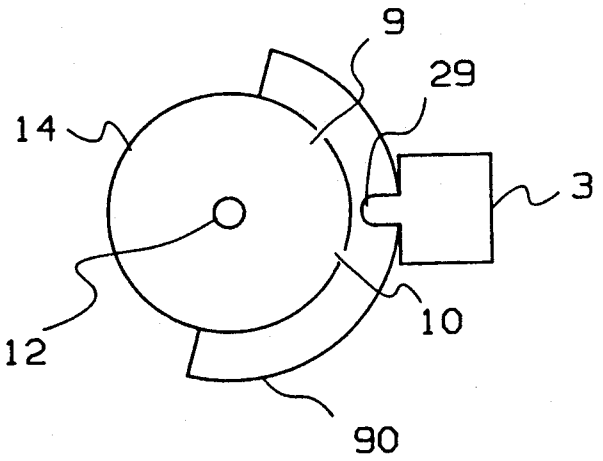
FIG. 5 shows an embodiment of the invention wherein a waveguide runs along the circumference of the cavity, and a magnetron is mounted towards one end of the waveguide.

FIG. 5 show a further embodiment, wherein an arcuate waveguide 90 has a radius such that it fits the outside cylindrical wall 14 of a $TE_{111}$ cavity. 1. The cavity and the waveguide 90 preferably have a wall in common. Two coupling slots 9,10 are arranged on the common wall and are separated by 90°. A magnetron 3 is mounted on the wall of the waveguide 90 opposite to the wall shared with the cavity wall 18. The magnetron 3 is centered with respect to the coupling slots 9,10. The waveguide 90 extends farther past one slot than the other. Alternatively, the extension of the waveguide 90 past the slots 9, 10 could be equal and the magnetron 3 could be positioned closer to one slot. As a second alternative, the magnetron 3 could be centered with respect to the ends of the waveguide 90 and the slots 9,10 could be moved towards one end. According to the above design arrangements, the exact positions of the slots 9,10, waveguide 17 and magnetron 3 would be set so that the difference between the distances from the magnetron 3 to the two slots 9,10 would be an odd multiple of one quarter the wavelength of the microwaves in the waveguide, or so that the waveguide extending beyond the slots would serve as a phase shift element causing a differential phase shift of 90°.

Figure 6:
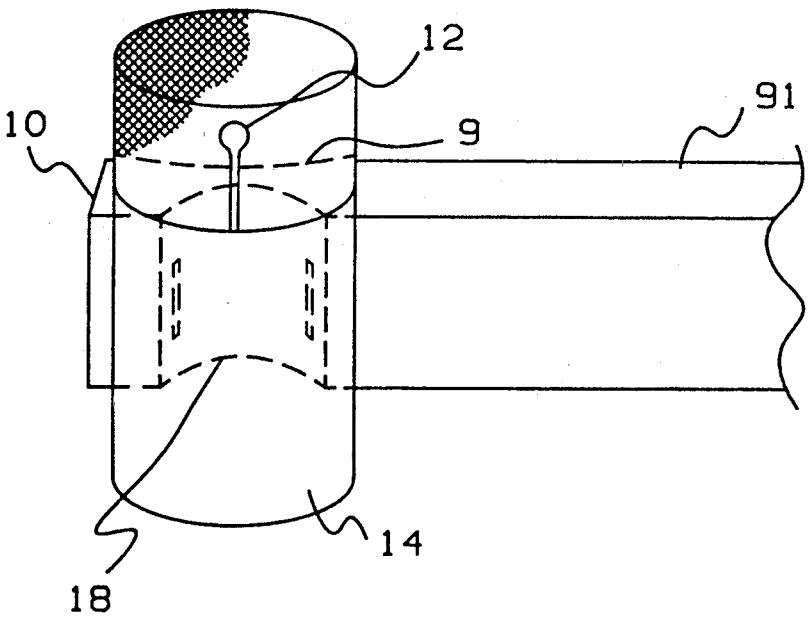
FIG. 6 shows a further embodiment of the invention.

In the embodiment of FIG. 6, a waveguide 91 is joined along its side to a cylindrical cavity which is sized to support a $TE_{111}$ mode. An arched section 18 of the waveguide is cut out and the cylindrical wall 8 of the cavity fits in the arched cut out 18. Two coupling slots 9,10 spaced by 90° on the cavity wall are located on the a curved cylindrical wall section which is in the arched section 18 of waveguide 91. The waveguide is dimensioned so that the phase of the microwave energy reaching the respective slots 9,10 is different by one quarter cycle. In this way a rotating electric field vector is achieved at the center of the cavity where an electrodeless bulb 12 is located.

FIGS. 7 and *7a* depict a further embodiment wherein a cylindrical $TE_{111}$ cavity has a first slot 9 and a second slot 10 located 90° apart on the cylindrical cavity wall 14. A first waveguide section 30 which is at least one half a wavelength long in terms of the wavelength of a microwave signal in the waveguide is connected over the first slot 9 so that it projects radially from the cavity. A metal slab called a short 31 which fits the cross section of the first waveguide is fitted into it. Beryllium copper spring finger gasketing 32, or other means providing a similar function is disposed at the edge of the short 31 to provide conduction between the short and the first waveguide 30, to provide for axial movement of the short for tuning purposes. A second waveguide 33 which is at least about one quarter wavelength long is connected in the same way to the second slot 10. A magnetron (not shown) is coupled to the second waveguide 33 near the end opposite the second slot 10. The two waveguides are joined together by a space 34 between them which is bounded by the cavity wall portion 36 on one side and a wall 37 opposite the cavity wall which connects to two facing walls of the two waveguides. Additionally, the space 34 is bounded by top and bottom walls, which are joined or continuous with the top and bottom walls of the waveguides.

Microwave energy propagates from the magnetron end of the second waveguide towards the second slot 10. Some of the energy is coupled through the second slot 10 into the cavity. A remaining portion propagates further and couples into the first slot 9. By moving the short 31, the phase difference between the two slots 9,10 and the relative power coupled through the two slots 9,10 can be changed. The object is to obtain equal power coupling through the two slots 9,10 and a 90° phase difference. An indication that this has been obtained is that a measurement of the light emitted by the discharge bulb demonstrates that it is azimuthally uniform.

FIGS. 8 and 9 show still another embodiment of the invention. In this embodiment, the cavity is mounted on the wide side of a waveguide 50, which is operated in the $TE_{111}$ mode. A cross shaped coupling iris 51,52 interfaces the cavity to the waveguide 50. The $TE_{111}$ cavity is mounted off the center of the wide face of the waveguide 50, while the cross shaped iris 51,52 is centered with respect to the cavity. The exact position off center that the cavity is mounted is such that a rotating H-field appears at the iris. The rotating H field causes a $TE_{111}$ mode pattern in the cavity to rotate once every microwave cycle. The distance off center that the cavity is mounted is the position where the maximum H field in the direction of the length of the waveguide equals the maximum H field in the direction across the waveguide and the maximums are one quarter cycle out of phase. This position is determined by equating the formulae for the magnitudes of the respective components of H as a function of the position across the waveguide to each other, and solving for the position.

The waveguide 50 is tapered down near the junction to the cavity, and has a lower height under the cavity. The lesser height is provided to prevent reflection of the microwave signal from the end of the waveguide opposite the magnetron. The reflected wave would tend to cause the H field in the slot to rotate in the opposite direction than is caused by the original wave, and it would thus tend to cancel the rotation.

As an alternative to using a reduced height waveguide, other techniques known in the microwave art could be employed to avoid cancellation of the rotation by a reflected wave. For example, a microwave absorption material could be disposed in the end of the waveguide 50 opposite the magnetron.

Referring to the drawings, FIGS. 10 and 11 depict still a further embodiment of the invention. In this embodiment, a cylindrical shaped cavity 1 is dimensioned approximately as a $TE_{111}$ cavity, while the exact dimensions may be found by experiment. The cavity has a mesh top portion 13 for example of tungsten which is reinforced by metal ribs 20 a solid metallic lower section 14, for example of aluminum. The cavity has a single coupling slot 95. Two inserts 21 having arcuate faces 22 which fit against the cavity wall and straight faces 23 are inserted in the cavity. The inserts 21 are opposite each other and positioned with the line between their apexes at a 45 degree angle with respect to a diameter through the iris. The inserts 21 are shorter than the cavity, i.e., they do not extend beyond the solid portion 14 of the cavity so they do not interfere with light emission. This cavity will now support two modes which are distorted cylindrical cavity $TE_{111}$ modes. Unlike the cylindrical cavity depicted in FIG. 1, in this cavity there are two preferred polarizations of the mode in the cavity. These two preferred modes are orthogonal to each other such that the electric fields associated with the two modes are orthogonal to each other at the center of the cavity.

In effect, there are two cavities tuned to two different frequencies in one. The first cavity is associated with the mode whose electric field lines generally cross from one insert to the other. The first cavity is tuned by sizing the cavity parts, etc. so that it's resonant frequency is lower than the driving frequency, e.g., 2.45 GHz, by one half the loaded (i.e. lamp fully ignited) bandwidth of the first cavity. Accordingly, the first cavity mode oscillation lags the phase of microwaves appearing at the slot by 45 degrees.

The second cavity is associated with the mode whose electric field lines cross between the inserts. The second cavity is tuned by sizing the cavity parts, etc. so that it's resonant frequency is higher than the driving frequency by one half the loaded bandwidth of the second cavity. Accordingly, the second cavity mode oscillation leads the phase of microwave appearing at the slot by 45 degrees.

The total difference between phase of the oscillation associated with the first cavity and that associated with the second cavity is 90 degrees. Also, the electric fields at the center of the cavity 1 associated with the respective first and second cavities are perpendicular to each other. Accordingly, the sum of the electric fields at the center of the cavity has a constant magnitude and rotates once every microwave cycle.

FIG. 12 depicts still a further embodiment of the invention. In this embodiment, a hexahedron shaped cavity is made up of a solid metal wall section 14 and a mesh wall section 13. A single coupling slot 96 is located on a first edge 41 of the cavity. A first side 41 which joins to said first edge 40 and the side opposite it is longer than a second side 42 which joins to said edge 40 and a wall opposite said second side. A discharge bulb 12 is located on a centerline of said cavity parallel to the first edge 40.

The cavity is capable of supporting two orthogonal modes of oscillation. The first mode has electric field lines generally perpendicular to the first side 41. A second mode of oscillation has electric field lines generally perpendicular to the second side 42. The mode is preferably the $TE_{101}$ mode. The difference in resonant frequencies of the two modes is such that one mode leads the other by one quarter cycle. This is achieved as described in connection with the previously described embodiment.

In this and the previously described embodiment it is also possible to have the one mode lagging the signal at the slot by some angle $\phi$ and to have the other mode leading the signal at the slot by the angle $90° - \phi$.

As an alternative to what is depicted in FIGS. 11 and 12, instead of using a coupling means, a magnetron can be directly mounted to the cavity at the position of the coupling iris such that its antenna projects into the cavity in the direction towards the center of the cavity.

FIG. 13 depicts a further embodiment of the invention. In this embodiment, a main waveguide 60 is divided into two equal length branches 61,62. A first branch 61 has a capacitive iris 63 located between the connection to the main branch 5 and the connection to a $TE_{111}$ cavity. The second branch 62 has an inductive iris 64 between the connection to the main branch 5 and the connection to the same $TE_{111}$ cavity. Both branches are preferably coupled to the $TE_{111}$ cavity through inductive irises 9,10. Capacitive irises or irises that are neither capacitive or inductive could also be used for coupling.

The combination of the capacitive iris 63 in the first branch and the inductive iris 64 the second branch causes there to be a 90° phase difference between the microwave signals appearing at the inductive irises 9,10 at the ends of the branches 61,62. A rotating $TE_{111}$ mode is established in the cavity.

Alternatively, the function and structure of the coupling irises 9,10 and the phase shifting irises 63,64 could be combined. That is, the branches would not have mid-length irises but rather an inductive iris would be used at the cavity coupling end of one branch and a capacitive iris would be used at the cavity coupling end of the other branch.

FIG. 14 depicts a variation on the embodiment shown in FIG. 13. In this embodiment, a magnetron 3 is disposed in the center of a waveguide 70 whose two ends are coupled to a $TE_{111}$ cavity through a first inductive iris 9 and a second inductive iris 10. The inductive irises 9,10 on the cavity wall are spaced 90° apart. Between the magnetron 3 and a first inductive iris 9, is a capacitive iris 71. Between the magnetron 3 and the second inductive iris 10 is another inductive iris 72. The design of this embodiment is space efficient.

FIG. 15 shows still another embodiment. Here, a magnetron 3 is mounted to a box shaped microwave enclosure 80, which intersects a cylindrical cavity. At the intersection, the planar wall of the enclosure is open. The cylindrical wall of the cavity extends into the enclosure 80 so that about half of the cavity is in the enclosure. Two coupling irises 9,10 are located 90° apart on the portion of the cylindrical wall 8 of the cavity that is in the enclosure 28. They are unequally spaced from the magnetron antenna 81 so that the phase of the microwaves appearing at one slot 9 is one quarter of a cycle different from that appearing at the other slot 10.

The enclosure may be made in various shapes as required by packaging and design considerations. It is only necessary that the enclosure supports microwave oscillation which has an odd multiple of one quarter wavelength between the locations of the two slots.

FIG. 16 depicts still another embodiment. In this embodiment, a magnetron 3 is mounted on a waveguide 82. The waveguide 82 extends in two directions from the magnetron 3, and is bent so that the ends join a $TE_{111}$ cavity at locations which are spaced 90° from each other on the cavity wall. Inductive or capacitive coupling irises 9,10 are disposed at these locations at the ends of the waveguide 82. A dielectric slab 83 is fitted inside the waveguide 82 on one side of the magnetron 3. The dielectric slab 83 changes the phase of microwaves reaching the iris 9, so that there is a quarter wave phase difference between the microwave signals appearing at the slots 9,10.

It should be noted, that in lieu of the dielectric slab any suitable means known in the art can be interposed in one or both ends of the waveguide so as to achieve the desired phase difference between the signals appearing at the two slots.

An actual lamp was constructed in accordance with the embodiment shown in FIG. 2. A spherical bulb having a volume of 12 cc was located on the center axis of the cavity. It was filled with 1 mg of dysprosium iodide, 1 mg of mercury iodide, and 60 torr of argon.

It should be appreciated that while the invention has been described in accordance with illustrative embodiments, variations will be apparent to those who are skilled in the art. For example, while many of the foregoing embodiments employ cylindrical cavities, the invention could be applied to other cavity shapes which can support two non-parallel modes of oscillation, for example a cube. Additionally, while the bulb has been shown as being axially located, it may be located off axis.

In view of the above, it should be appreciated that the invention is to be limited only by the claims appended hereto, as well as equivalents.

We claim:

1. A microwave powered electrodeless lamp comprising, a microwave cavity with at least one opening in the cavity through which microwave energy may be coupled to the cavity, a bulb containing an excitable fill disposed in said cavity at a particular location, microwave energy generating means, and means for coupling microwave energy from said microwave energy generating means through said at least one opening in said cavity in such manner that a rotating electric field of constant ellipticity is established in said cavity at the particular location of said bulb.

2. The lamp of claim 1 wherein the microwave cavity is comprised of a solid metallic member and a metallic mesh member, and wherein said at least one cavity opening is in the solid metallic member.

3. The lamp of claim 2 wherein said at least one cavity opening comprises a slot antenna.

4. The lamp of claim 3 wherein the polarization of said field is substantially a circular polarization.

5. The lamp of claim or 4 wherein said microwave energy generating means comprises a single microwave source.

6. The lamp of claim 5 wherein the field in the cavity is in a single mode.

7. The lamp of claim 5 wherein the fill in said bulb is at a pressure of from 1 to 20 atmospheres during operation.

8. A microwave powered lamp, comprising a microwave cavity comprised of a solid metallic member and a mesh member, wherein the solid metallic member has at least one coupling slot therein for coupling microwave energy into the cavity, a bulb containing an excitable fill disposed in said cavity at a particular location, microwave energy generating means, and means for coupling microwave energy from said microwave energy generating means to said at least one coupling slot in such manner that a rotating electric field of approximately circular polarization is established in said cavity at the particular location of said bulb.

9. The lamp of claim 8 wherein said solid metallic member of said microwave cavity comprises a reflector for reflecting the light which is emitted by said bulb out of said cavity through said mesh member.

10. The lamp of claim 9 wherein the microwave cavity is cylindrical, and said means for coupling includes slots in the cavity wall having a long dimension which runs in the direction of the axis of the cylindrical cavity.

11. A microwave powered electrodeless lamp comprising, a cylindrical microwave cavity having two coupling slots in the cavity wall which are separated from each other by a certain spatial angle, a bulb containing an excitable fill disposed in said cavity at a particular location, a single microwave source, and means for coupling microwave energy from said single microwave source to said coupling slots so that the wave energy which is fed into the respective slots has certain amplitudes and a certain phase difference, wherein said certain spatial angle, said certain amplitudes and said certain phase difference are such to result in a rotating field in the cavity having an ellipticity of at least 0.6.

12. The lamp of claim 11 wherein said microwave cavity is comprised of a solid portion and a mesh portion, and the coupling slots are located in the solid portion, and have their long dimension parallel to the cylindrical axis of the cavity.

13. The electrodeless lamp of claim 12 wherein both said spatial angle and said phase difference are at least about 60° but not more than about 90°.

14. The electrodeless lamp of claim 13 wherein said certain amplitudes are about equal and wherein both said spatial angle and said phase difference are about 90°.

15. The lamp of claim 14 wherein the wave energy which is fed into the respective slots is in the same mode.

16. The lamp of claim 14 wherein the fill in said bulb is at a pressure of from 1 to 20 atmospheres during operation.

17. The lamp of claims 11 or 14 wherein said means for coupling comprises microwave transmission means having an effective length from the microwave source to one coupling slot which is longer than the effective length from the source to the other coupling slot, to achieve said constant phase difference.

18. The lamp of claim 17 wherein said microwave transmission means comprises waveguide means.

19. The lamp of claim 18 wherein said waveguide means includes branches having different lengths.

20. The lamp of claim 18 wherein said waveguide means includes a portion which extends between one coupling slot and the other coupling slot.

21. The lamp of claim 20 wherein said waveguide means includes a main portion which extends from the source to one of the coupling slots.

22. The lamp of claim 21 wherein said waveguide means includes a portion which wraps around the cylindrical cavity.

23. The lamp of claim 20 wherein the antenna of the microwave source is inserted in said waveguide portion which extends between one slot and the other coupling slot.

24. The lamp of claim 18 wherein said waveguide means includes a first waveguide portion which extends between said source and one of said coupling slots, a second waveguide portion which extends between a short and the other of said coupling slots, and a third waveguide portion which connects said first and second waveguide portions.

25. The lamp of claim 24 wherein said short in said second waveguide portion is a movable short.

26. The lamp of claim 17 wherein said microwave transmission means comprises a metal box which is fed with microwave energy from said source at a position which is closer to one of said coupling slots than to the other.

27. The lamp of claim 11 wherein said means for coupling includes waveguide means having two branches, and wherein phase shift means is included in at least one of said branches.

28. The lamp of claim 27 wherein said phase shift means comprises an inductive iris in one of said branches and a capacitive iris in the other of said branches.

29. The lamp of claim 27 wherein said phase shift means comprises a dielectric slab.

30. An electrodeless lamp comprising, a cylindrical cavity having two slots which are disposed about 90° from each other around the cylindrical cavity wall, a bulb having an excitable fill disposed in the cavity at a particular location, a source of microwave energy, a first waveguide for feeding microwave energy from said source to one of said slots, a second waveguide, which has a movable short, communicating with the other of said slots, and said first and second waveguides being connected to each other by an enclosure for microwaves which includes a part of the cavity wall as one wall, and other walls which communicate between the two waveguides.

31. An electrodeless lamp, comprising, a cylindrical cavity having two slots which are disposed about 90° from each other around the cylindrical cavity wall a bulb having an excitable fill disposed in the cavity at a particular location, a source of microwave energy, means for coupling microwave energy from said source to said cavity in such manner as to create a rotating electric field in the cavity having a circular polarization at the location of said bulb, wherein said means for coupling comprises, a) a first waveguide which communicates between said source and one of said slots, b) a second waveguide having a moveable short which communicates with the other of said slots, and c) a microwave enclosure which communicates between said first and second waveguides.

32. The electrodeless lamp of claim 31 wherein one wall of said enclosure is a part of the cylindrical cavity and other walls of said enclosed connect the first and second waveguides to each other.

33. The electrodeless lamp of claim 32 wherein part of said cylindrical cavity is comprised of a mesh member which allows light to exit, and wherein the cavity is resonant when operating.

34. The electrodeless lamp of claim 32 wherein the field which is established in said cavity is in a single mode.

35. An electrodeless lamp comprising, a cylindrical cavity which is comprised of a cylindrical wall having first and second ends, a mesh member proximate said first end, a bulb containing an excitable fill disposed in the cavity at a particular location, a microwave source, a waveguide communicating between said source and the second end of said cavity, said waveguide having two slots which overlie each other in a cross configuration at the second end of said cavity for feeding microwave energy into said cavity at said second end.

36. An electrodeless lamp comprising, a cylindrical cavity having a cylindrical wall with a coupling slot therein, and a mesh member proximate one end of the cavity, a pair of metallic inserts in the cavity proximate the other end, which form opposing straight surfaces inside the cavity which are separated from each other by a substantial part of the diameter of the cavity, a microwave source, and means for coupling microwave energy from said source to said coupling slot.

37. The electrodeless lamp of claim 36 wherein said opposing surfaces are at an angle of about 45° with regard to a diameter of the cavity which passes through the coupling slot.

38. An electrodeless lamp comprising, a microwave cavity in the shape of a rectangular parallelpiped having two long sides and two short sides, and having four edges at which long sides adjoin short sides, the cavity having a mesh member proximate one end, a coupling slot disposed in the cavity in one of said edges, a bulb having an excitable fill located in said cavity, a microwave source, and means for coupling microwave energy from said source to said coupling slot.

39. An electrodeless lamp comprising, a cylindrical cavity having a cylindrical wall in which there are two coupling slots separated by about 90°, the cavity having a mesh member proximate one end, a microwave source, and an enclosure for coupling microwave energy from said source to said coupling slots, said source being arranged to feed microwave energy to said enclosure, and said enclosure being arranged to encompass both said coupling slots.

40. The electrodeless lamp of claim 39 wherein said source is disposed in a wall of said enclosure which is opposite to said cylindrical cavity wall and is not equidistant from said two coupling slots.

41. A microwave powered lamp comprising, a cylindrical microwave cavity comprised of a solid portion and a mesh portion, wherein the solid portion has two coupling slots therein which are separated by a spatial angle of approximately 90°, said cavity being resonant during lamp operation, a bulb containing an excitable fill disposed in said cavity at a particular location, a single microwave energy generating means, and means for feeding microwave energy from said generating means to said slots so that the wave energy which is fed into the respective slots has an electrical phase difference of approximately 90° for establishing in said cavity at the particular location of said bulb, an electrical field in a single mode which rotates with a circular polarization.

* * * * *